United States Patent [19]

Otting et al.

[11] Patent Number: 4,547,921

[45] Date of Patent: Oct. 22, 1985

[54] PATTERN DYEING OF TEXTILE MATERIALS SUCH AS CARPET

[75] Inventors: Billy J. Otting; Alfred Clifford, both of LaFayette, Ga.

[73] Assignee: Otting Machine Company, Incorporated, LaFayette, Ga.

[21] Appl. No.: 387,291

[22] Filed: Jun. 10, 1982

Related U.S. Application Data

[63] Continuation of Ser. No. 156,624, Jun. 5, 1980, abandoned.

[51] Int. Cl.[4] ..... D06B 1/06

[52] U.S. Cl. ..... 8/151; 68/205 R

[58] Field of Search ..... 8/149, 151; 68/200, 68/205 R; 251/5-7; 239/551, 562, 567; 118/324, 325, 684

[56] References Cited

U.S. PATENT DOCUMENTS

| | | | |
|---|---|---|---|
| 1,427,455 | 8/1922 | Gates | 251/7 X |
| 1,677,453 | 7/1928 | Jones | 251/7 X |
| 2,218,811 | 10/1940 | Chaussabel | 68/205 R X |
| 3,443,878 | 5/1969 | Weber et al. | 68/183 X |
| 3,570,275 | 3/1971 | Weber et al. | 68/205 R |
| 3,683,649 | 8/1972 | Takriti et al. | 68/205 R X |
| 3,688,530 | 9/1972 | Harris et al. | 68/205 R |
| 3,731,503 | 5/1973 | Appenzeller et al. | 68/205 R |
| 3,739,605 | 6/1973 | Baker | 68/205 R X |
| 3,785,179 | 1/1974 | Davis et al. | 68/205 R X |
| 3,793,785 | 2/1974 | Austin | 251/7 X |
| 3,800,568 | 4/1974 | Takriti et al. | 68/205 R |
| 3,801,275 | 4/1974 | Stankard et al. | 8/149 |
| 3,903,715 | 9/1975 | Plotz | 68/205 R |
| 3,921,670 | 11/1975 | Clippard, Jr. et al. | 251/129 X |
| 3,937,044 | 2/1976 | Balmforth | 68/205 R |
| 3,964,860 | 6/1976 | Leifeld | 68/205 R X |
| 3,969,779 | 7/1976 | Stewart, Jr. | 8/149 |
| 3,985,006 | 10/1976 | Klein | 68/205 R |
| 4,033,153 | 7/1977 | Ahrweiler et al. | 68/205 R |
| 4,033,154 | 7/1977 | Johnson | 68/205 R |
| 4,116,626 | 9/1978 | Varner | 8/149 |
| 4,127,014 | 11/1978 | Miller et al. | 68/205 R X |
| 4,157,652 | 6/1979 | Mathes et al. | 68/205 R X |
| 4,170,958 | 10/1979 | Moser | 68/205 R X |

FOREIGN PATENT DOCUMENTS

| | | | |
|---|---|---|---|
| 1288681 | 9/1972 | United Kingdom | 68/205 R |
| 1296725 | 11/1972 | United Kingdom | 68/205 R |

*Primary Examiner*—Philip R. Coe

*Attorney, Agent, or Firm*—Kerkam, Stowell, Kondracki & Clarke

[57] ABSTRACT

A versatile carpet dyeing applicator capable of producing novel and visually pleasing multicolor pattern effects ranging from apparently completely random to fairly well-defined. An inclined distributing plate such as a conventional doctor blade extends across the width of the carpet web, transverse to the direction of web travel, with a lower edge of the distributing plate positioned so that dye flowing off falls on the carpet web. Means, such as a conventional dye pickup roller rotating in a dye supply trough, introduces liquid of a base color onto the distributing plate at an upper edge thereof to form a base color dye film initially flowing substantially uniformly downwardly over the distributing plate. At least one plurality of delivery tubes has outlet ends spaced along the distributing plate with the outlet ends positioned above and directed towards the distributing plate for adding dye or chemical of at least one additional color or other characteristic to the base color dye film in selected areas of the distributing plate. Thus, mixing and spreading occurs on the surface of the distributing plate. The dye delivery tube outlet ends are spaced on approximately two-inch centers, and are carried by a moving nozzle bar extending across the width of the carpet web. A controlled valving arrangement selectively provides the dye or chemical of the at least one additional color or characteristic to individual ones of the dye delivery tubes under pattern control. For supplying additional dye colors to the doctor blade, it is preferred that there are a plurality, for example three, of independently reciprocating nozzle bars, with separate colors or other characteristics.

21 Claims, 7 Drawing Figures

PATTERN DYEING OF TEXTILE MATERIALS SUCH AS CARPET

This application is a continuation of application Ser. No. 156,624, filed June 5, 1980, and now abandoned.

BACKGROUND OF THE INVENTION

The present invention relates generally to pattern dyeing of textile material, for example carpet, and, more particularly, to the dispensing of multiple dye colors on carpet in a variety of patterns, including irregular and apparently random patterns.

The printing of tufted carpets in well known in the art, and is carried out by a variety of techiques. At the present time, most carpet printing is done by techniques more or less analogous to conventional printing techniques, such as rotary printing and screen printing. The use of such traditional carpet printing techniques requires an individual roller or screen for each color of each individual pattern which it may be desired to print. These rollers or screens are typically twelve or fifteen feet wide, and involve great expense both in initial manufacture and in storage.

Recently, a variety of other techniques have been proposed and implemented to produce a wide variety of visually pleasing carpet printing effects, essentially limited only by imagination.

One attractive alternative to carpet printing techniques is controlled dye jet printing wherein plural colored dyes are sprayed or jetted onto the surface of relatively moving textile material. Generally, such jet printing machines comprise a plurality of dye applicators extending across the path of carpet travel, each dye applicator including a multiplicity of dye outlet tubes or nozzles extending in a line along the applicator transverse to the direction of carpet travel, with the nozzles of each of the applicators being supplied with a different color dye. Each individual nozzle or jet is controllaby actuated by suitable electronic, pneumatic or mechanical means to dispense dyes onto the moving textile material under control of a suitable pattern controller. By way of representative example, one general form of jet printing apparatus, along with various forms of controllers, is disclosed in the following patents: Weber et al U.S. Pat. Nos. 3,443,878 and 3,570,275; Stewart, Jr. U.S. Pat. No. 3,969,779; Kline U.S. Pat. No. 3,985,006; Johnson U.S. Pat. No. 4,033,154; and Varner U.S. Pat. No. 4,116,626. Another, particularly effective type of jet pattern dyeing apparatus is disclosed in pending U.S. Application Ser. No. 085,943, filed Oct. 18, 1979, by Billy Joe Otting, and entitled "Jet Pattern Dyeing of Material, Particularly Carpet," which was continued as application Ser. No. 237,577, filed Feb. 24, 1981, now U.S. Pat. No. 4,341,098.

It will be appreciated that such jet pattern dyeing or printing machines, through suitable programming of the individual closely-spaced dye nozzles, are capable of producing an extremely wide variety of carpet printing effects, particularly when it is considered that dyes of various viscosities may even be employed to produce effects other than would apparently be possible merely with pattern control. With jet printing apparatus, pattern effects may range from extremely intricate and closely repeated patterns, limited only by the resolution of the apparatus determined by nozzle spacing (typically 0.1 inch), to apparently random effects effected by causing irregular shapes of various colors and sizes to be jet printed on the carpet through suitable pattern control.

However, the high precision and resolution possible with a controlled dye jet printer, together with attendant cost, is not necessary for all applications. In the carpet industry, much time and effort is expended to create different and original color patterns in pile materials. Different forms of applicators, although not capable of the resolution of true controlled jet pattern apparatus wherein controlled dye nozzles apply color dyes directly to the carpet, have been proposed employed for pattern dyeing of carpet in varying degrees of randomness, frequently with novel and visually pleasing results.

One such example is known in the art as "TAK" dyeing. In TAK dyeing, carpet is conveyed under a dye applicator which drips or splatters dye onto carpet yarn conveyed below the applicator. The applicator includes a lick roll which picks up dye from a trough, and the dye is scraped from the lick roller by a doctor blade. The doctor blade includes a plurality of individual channels for dividing the dye into a plurality of separate dye streams. The dye streams, as they issue from the doctor blade, are broken up into smaller streams or drippings by mechanical dye stream interrupter elements positioned below the lower edge of the doctor blades. To randomize the pattern, various devices oscillate both the doctor blade carrying the separate streams, and the mechanical interrupter devices. By way of example, such TAK dyeing machines are disclosed in the following patents: Takriti et al U.S. Pat. No. 3,683,649; Appenzeller et al U.S. Pat. No. 3,731,503; and Takriti et al U.S. Pat. No. 3,800,568.

A variation on the TAK dyeing process is disclosed in the Miller et al U.S. Pat. No. 4,127,014. The disclosed Miller et al machine is capable of multicolor TAK dyeing, and includes a pair of opposed identical applicators, each including a plurality of channel-like doctor blade extensions for producing separate dye streams, which are then broken up by various mechanical interrupters positioned below the channel outlets. In addition to the dye scraped by the doctor blade from the dye pick-up roll, adjustable blocking plugs or wedges are provided to stop the flow of dye from particular channels, and a separate dye conduit and valving arrangement permits dye of a color different from the base color scraped off by the doctor blade to fall in place of the dye from individual blocked off channels.

Another variation on the TAK dyeing process is the apparatus disclosed in the Balmforth U.S. Pat. No. 3,937,044. The Balmforth apparatus employs a flat doctor blade, with a separate reciprocating corrugated sheet defining channels disposed beneath the lower edge of the doctor blade.

Another form of more or less random patterning carpet dyeing apparatus is known as a "Polychromatic dyeing machine". Examples are disclosed in the Harris et al U.S. Pat. No. 3,688,530 and the Stankard et al U.S. Pat. No. 3,801,275. A polychromatic dyeing machine comprises one or more rows of dye nozzles or jets, each row of nozzles being mounted on a respective carriage bar which is reciprocal transversely of the carpet web. Liquid dye streams from the nozzles directly onto the carpet web or other fabric to be dyed. If the design pattern to be applied is merely a stripped design, the carriage bars remain stationary during the passage of the carpet web there beneath. When it is intended to vary the pattern, the carriage bars are reciprocated in various predetermined motions. Of similar effect are the machines disclosed in the Chaussabel U.S. Pat. No. 2,218,811 and the Davis et al U.S. Pat. No. 3,785,179.

Still another form of apparatus for dyeing textiles and carpets in more or less random patterns through control of the dye application is known in the art as "Kusters Color", and is for example disclosed in the Leifeld U.S. Pat. No. 3,964,860 and the Moser U.S. Pat. No. 4,170,958. This type of applicator employs a dye pick-up roll which transfers dye in liquid form to a substantially flat, inclined doctor blade. The film of dye flowing over the doctor blade is irregularized by being diverted by means of narrow mechanical scraper blades or air blasts directed at the doctor blade or pick-up roll. In one particular form of the Kusters Color apparatus, the air blasts are delivered by a rotating and reciprocating hollow tube extending across the doctor blade, with a plurality of air outlet openings distributed over the surface of the hollow tube.

Still another form of carpet patterning apparatus is disclosed in the Ahrweiler et al U.S. Pat. No. 4,033,153 wherein a rotating pick-up roll transfers dye from a reservoir trough to a substantially flat doctor blade, and a plurality of vertically pivoting channels are provided at the bottom end of the doctor blade. The channels are individually pivotable between one position in which dye liquid is permitted to flow onto the carpet, and another position in which the liquid dye is directed to a catch pan from which it can be returned to the dye reservoir trough.

Yet another form of apparatus for producing irregular dyeing effects on carpet is disclosed in the Plotz U.S. Pat. No. 3,903,715. In the Plotz apparatus, dye liquid is applied by means of rotating discs arranged in horizontal position above the carpet. Dye liquid is supplied either continuously or in drops to the surfaces of the rotating discs, and centrifugal force divides the dye into individual drops of different size and spreads the dye over the width of the carpet.

Another form disclosed in the Mathes et al U.S. Pat. No. 4,157,652 employs a plurality of rotating drums positioned above the carpet web. Each of the drums has a plurality of cavities formed in the outer surface thereof, and dye is supplied to these cavities. As the drums rotate, dye falls from the cavities onto the carpet web traveling therebeneath, forming an irregular and random pattern.

From the foregoing, it will be appreciated that a wide variety of techniques and apparatus have been proposed for continuous application of color patterns to carpet, in more or less random manner. The present invention provides such apparatus which is highly versatile, capable of producing an extremely wide range of pattern effects, and yet is relatively low in cost. Further, the applicator apparatus of the present invention may be retrofitted at relatively low cost to an existing uniform applicator comprising merely a rotative pick up roll and a doctor blade, with no means to vary the pattern absent apparatus of the present invention. Thus the benefits of the invention may be readily realized, as a practical matter, at minimal expense and inconvenience.

SUMMARY OF THE INVENTION

It is accordingly an object of the invention to provide a versatile carpet dyeing applicator substantially lower in cost than a full scale jet printer, but yet which is capable of producing novel and visually pleasing multicolor pattern effects in the carpet ranging from apparently completely random to fairly well defined patterns, limited only by the imagination of the carpet pattern designer.

It is another object of the invention to place in the hands of carpet pattern designers a versatile and effective carpet dyeing apparatus which may be effectively utilized to rapidly test and then commercially produce new and unique carpet designs, which hopefully will gain acceptance in the market place.

Briefly stated and in accordance with an overall concept of the invention, an inclined distributing plate such as a conventional doctor blade extends across the width of the carpet web, transverse to the direction of web travel, with a lower edge of the distributing plate positioned so that dye flowing off the lower falls on the carpet web. In addition, means, such as a conventional dye pickup roller rotating in a dye supply trough, introduces liquid of a base color onto the distributing plate at an upper edge thereof to form a base color dye film initially flowing substantially uniformely downwardly over the distributing plate.

In accordance with the invention, at least one plurality of delivery tubes has outlet ends spaced along the distributing plate with the outlet ends positioned above and directed towards the distributing plate for adding dye or chemical of at least one additional color or other characteristic to the base color dye film in selected areas of the distributing plate. Thus, mixing and spreading occurs on the surface of the distributing plate.

It is contemplated that, in usual applications, the additional dye or chemical will simply be dye of a different color. However, there is no intention to so limit the invention, as it is further contemplated that dyes of different viscosities, for example, can be employed for varied penetration effects. Similarly, various gums or resist chemicals, or even water, might be jetted onto the distributing plate.

Preferably, the dye delivery tube outlet ends are spaced on approximately two inch centers, and are carried by a nozzle bar extending across the width of the carpet web. A mechanism is provided for reciprocating the nozzle bar and dye delivery tubes back and forth in a direction transverse to the direction of web travel. Further, a controlled valving arrangement is provided for selectively providing the dye or chemical of the at least one additional color or characteristic to individual ones of the dye delivery tubes under pattern control.

While as few as one nozzle bar carrying a single set of dye delivery tubes may extend across the width of the carpet bed for supplying additional dye colors to the doctor blade, it is preferred that a plurality, for example three, of independently reciprocating nozzle bars, with separate colors or other characteristics, be provided.

This particular arrangement provides a highly versatile applicator, capable of a wide variety of pattern effects with varying degrees of randomness. Any number of forms of pattern control may be applied to the controlled valving arrangement, such as from a computer or an optical mylar film reader. Further, the nozzle bars may independently reciprocate at different speeds, further randomizing the pattern for various visually pleasing effects. Although, for reasons of cost, resolution is limited by the two-inch center-to-center spacing of the individual dye delivery or nozzle tubes, recognizable and repeatable patterns are produced on the carpet by appropriate pattern control through automatic selective actuation of the valves, if desired. Apparently random actuation patterns may be employed as well.

The two-inch nozzle tube spacing might well be unsatisfactory for many purposes in the event the dye or chemical were sprayed or jetted directly onto the carpet. In such event, stripes of undyed or base color dye might well appear between nozzle tubes. However, with the present invention, the spreading effect of the inclined distributing plate on the dye or other chemical eliminates such gaps. It will therefore be appreciated that the controlled jetting of dye or chemical onto the distributing plate, rather than directly on the carpet, is an important aspect of the invention.

In accordance with another aspect of the invention, a pattern dyeing apparatus is provided for retrofit combination with an existing carpet dyeing machine of the type including a rotating roller supplied with base color dye liquid from a trough, and an inclined doctor blade for scraping dye from the roller to cause a film of base color dye to flow uniformly downwardly over the doctor blade to fall from the lower edge of the doctor blade onto a carpet web conveyed therebelow. In particular, the retrofit pattern dyeing apparatus includes at least one nozzle bar extending across the width of the carpet web and carrying a plurality of dye delivery tubes having spaced outlet ends positioned above and directed towards the doctor blade for adding dye of at least one additional color to the base color dye film in selected areas of the doctor blade, with a mechanism for reciprocating the nozzle bar and dye delivery tubes back and forth in a direction transverse to the direction of web travel.

Preferably, there is a controlled valving arrangement for selectively providing dye to individual ones of the dye delivery tubes under pattern control. It is further preferred that a plurality, for example three, of reciprocating nozzle bars extending across the width of the web be provided, with each of the plurality of reciprocating nozzle bars carrying a row of dye delivery tubes having outlet ends spaced along and positioned above the doctor blade, with the outlet ends directed towards the doctor blade for adding additional dye to the base color dye film.

This retrofit combination approach provides a particularly inexpensive means for a carpet manufacturer to add pattern dyeing applicator apparatus in accordance with the present invention to an existing carpet dyeing line.

For reciprocating or otherwise moving the nozzle tube bars, it will be appreciated that a wide variety of mechanical and electromechanical mechanisms may be provided, and there is accordingly no intention to limit the invention to any particular form of such mechanism. However, a presently preferred form of reciprocating mechanism includes a reverseable pnuematic actuator for each nozzle bar, and a limit switch arrangement for sensing and defining the limit of nozzle bar travel in either direction, and reversing said pnuematic actuator when a limit of travel is reached. The velocity of reciprocation may readily be controlled by controlling the air pressure applied to the pnuematic actuator. Thus, the nozzle bars reciprocate more or less independently at the same time dye is delivered under pattern control.

The present invention additionally contemplates a method for dyeing textile materials such as carpets so as to form patterns thereon, the method including the steps of forming a base color dye film of a width substantially equal to the width of the textile material on an inclined plate, controllably discharging liquid dye streams of at least one additional color on to the upper surface of the inclined plate in selected areas of the inclined plate, laterally varying in reciprocating fashion the position of the liquid dye streams directed onto the inclined plate, and depositing the base color dye and the additional color dye onto the textile material by allowing dye liquid to fall from the lower edge of the inclined plate onto the textile material.

It will be appreciated that the apparatus and methods of the invention provide highly versatile apparatus for producing a wide variety of dye patterns on carpet. In particular, carpet designers are provided with the means to implement any number of nozzle and visually pleasing dyeing effects, heretofore unknown.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, and which:

DESCRIPTION OF PREFERRED EMBODIMENTS

Figure 1:
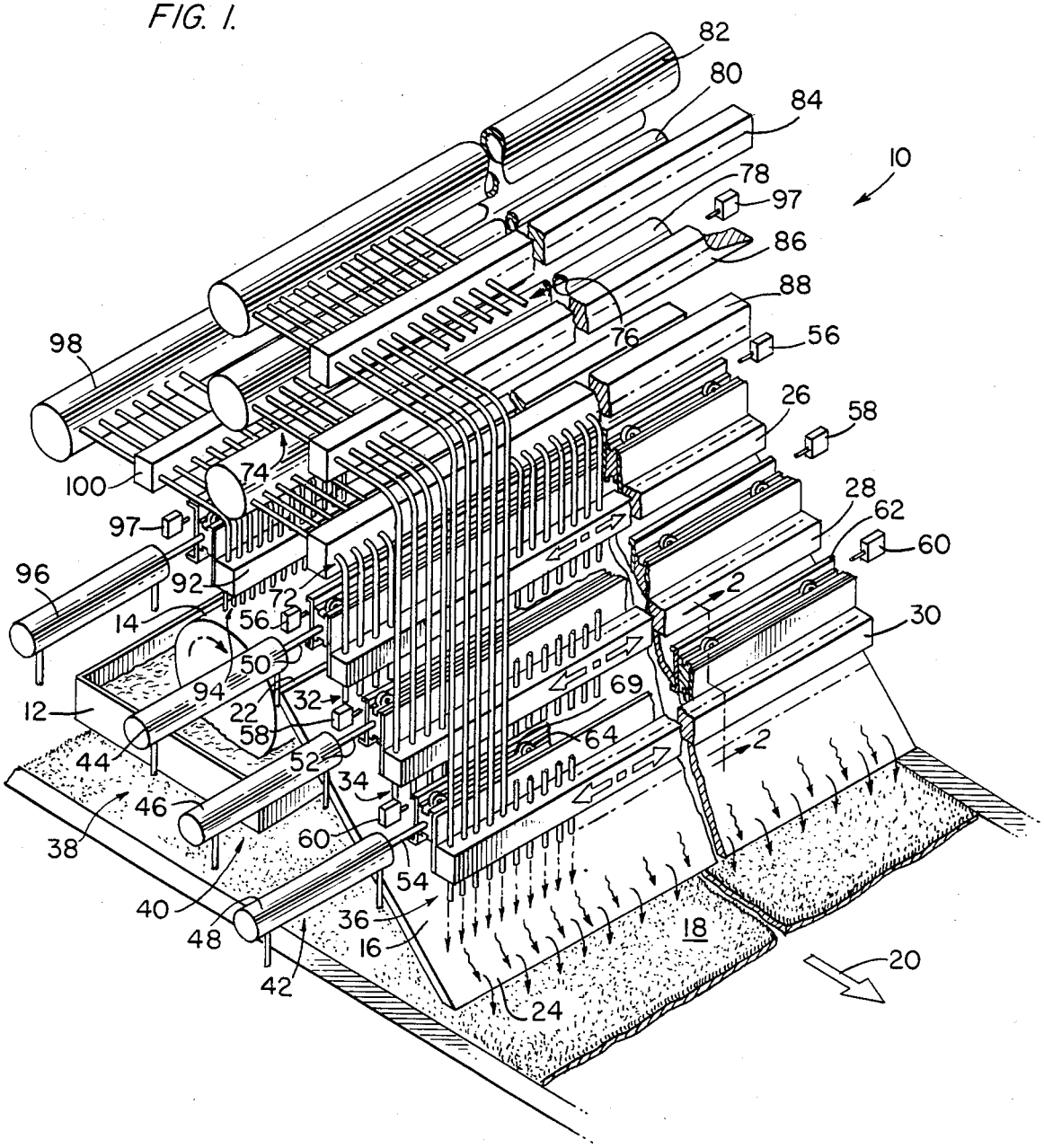
FIG. 1 is an overall highly-schematic prespective view of a single twelve or fifteen-foot wide applicator in accordance with the invention positioned over a moving carpet web.

Referring first to FIG. 1, an applicator, generally designated 10, includes a conventional dye reservior trough 12 containing base color liquid dye, and a horizontally disposed rotating dye pick up roll 14 dipped into the trough 12 so as to pick up a dye film. An inclined distributing plate in the form of a conventional doctor blade 16 extends across the width of an underlying conveyed carpet web 18 transverse to the direction of web travel as denoted by an arrow 20. Through scraping action of the doctor blade upper edge 22 which is held by spring pressure against the rotating roll 14, a film of base color liquid dye is introduced onto the doctor blade 16, and flows initially uniformly downwardly thereover to fall from the lower edge 24 thereof onto the carpet web 18.

While a rotating dye pickup roll 12 is illustrated, it will be appreciated that other means may be provided for introducing liquid dye of a base color onto the distributing plate 16, such as a liquid spraying arrangement near the upper edge of the plate 16.

It will be appreciated that FIG. 1 is highly schematic in order to illustrate the essential concepts of the invention, and that a number of structural elements such as side supports are, for clarity of illustration, omitted from the drawing. For example, a support bearing and rotating drive mechanism are required for the pick up roll 14; these are of conventional construction and are not shown. Similarly, a horizontal pivot support and spring are required to urge the doctor blade upper edge 22 against the pick up roll 14; these likewise are of conventional construction and are not shown. It will further be appreciated that the proportions of the applicator are greatly distorted by the break in the center representing omitted structure identical to that which is shown. A typical width for the applicator 10 is twelve or fifteen feet, to suit the width of the carpet web 18, and the applicator 10 may be two or three feet in height.

Although not illustrated in FIG. 1, it will be appreciated that a conventional steam chamber is provided to fix the dyes, as well as other conventional devices such as washers for excess dye and dryers.

In accordance with the invention, a plurality of nozzle bars, for example exemplary nozzle bars 26, 28 and 30 each carry a plurality of dye delivery tube outlet ends comprising individual small-diameter stainless steel tubing sections and collectively designated 32, 34 and 36, respectively, with the individual nozzle tube outlet ends spaced on approximately two inch centers along the respective nozzle bars. Preferably, the nozzle bars 26, 28 and 30 are each drilled to receive individual stainless steel nozzle tubes.

Figure 3:
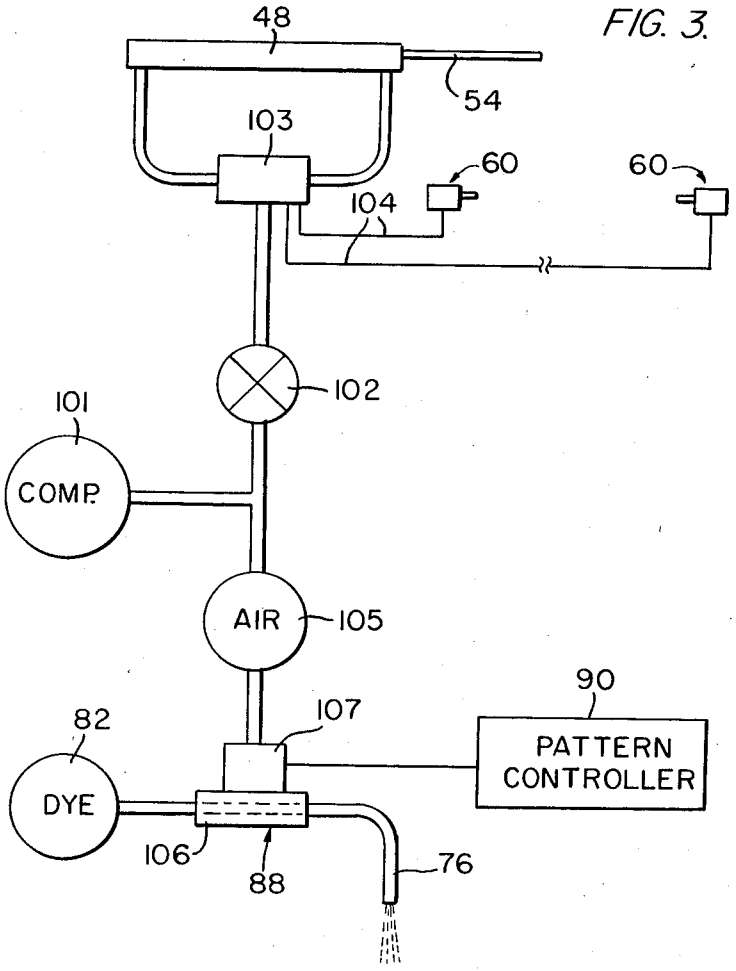
FIG. 3 is a highly schematic overall representation of one suitable form of arrangement for controlling the applicator apparatus of the invention.

Individual mechanisms, generally designated 38, 40 and 42 are provided for independently reciprocating the nozzle bars and dye delivery tubes back and forth. Preferably, the reciprocating mechanisms 38, 40 and 42 each comprise respective pnuematic actuators 44, 46 and 48 supplied from a compressed air source (FIG. 3). The bodies of the pneumatic actuators 44, 46 and 48 are fixedly mounted through suitable means, and have actuator rods 50, 52 and 54 which move in and out to impart motion to the nozzle bars 26, 28 and 30. The pnuematic actuators 44, 46 and 48 are reversible, and a limit switch arrangement comprising suitably-mounted limit switch pairs 56, 58 and 60 senses the limit of nozzle bar travel in either direction, and reverses the pnuematic actuators 44, 46 and 48 through conventional electromechanical connections (FIG. 3) when either limit of travel is reached.

Thus the nozzle bars 26, 28 and 30 reciprocate essentially independently, and the velocity of reciprocation can be independently controlled by varying the air pressure supplied to the pnuematic actuators 44, 46 and 48.

Figure 2:
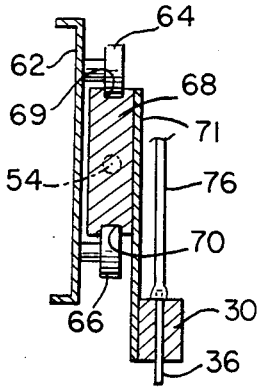
FIG. 2 is a section along line 2—2 of FIG. 1 showing the form of mounting arrangement for the reciprocating nozzle bars.

The mounting and support arrangement which permits reciprocating motion of the nozzle bars 26, 28 and 30 may more clearly be seen by additionally referring to FIG. 2 which shows the mounting and support arrangement for an exemplary nozzle bar 30. In particular, a fixed support plate 62 of general "C" configuration is securely mounted at its ends to side members (not shown), and carries a plurality of upper and lower guide rollers 64 and 66 having horizontal axes of rotation. A movable guide bar 68 has upper and lower guide channels or tracks 69 and 70 which respectively receive the guide rollers 64 and 66 for rolling support therebetween. As may be seen from FIG. 1, it is the guide bars such as the guide bar 68 to which the pnuematic actuator rods 50, 52 and 54 are actually attached. The remaining illustrated element of the nozzle bar mounting and support arrangement is a plate 71 for mounting the nozzle bar 30 to the guide bar 68.

For supplying the dye delivery tube outlet ends 32, 34 and 36, sets of dye delivery tubes 72, 74 and 76 comprising flexible and compressible plastic tubing are supplied from respective dye manifolds 78, 80 and 82 carrying dyes of different colors. For pattern control, a controlled valving arrangement includes valve blocks 84, 86 and 88 comprising individual valves for each of the nozzle tubes 32, 34 and 36 in the entire applicator 10. While a preferred form of valving arrangement is illustrated and described hereinbelow, other forms of valves may also be suitable. There is accordingly no intention to limit the scope of the invention to the precise form of dye valve shown.

In FIG. 1, the dye delivery tube portions 72, 74 and 76 are flexible to permit pinching for selective control of dye flow. A preferred form of valve assembly for multiple inclusion in each of the valve blocks 84, 86 and 88 is a pinch tube valve assembly described and claimed in pending U.S. Pat. Application Ser. No. 086,392, filed Oct. 18, 1979 by Billy Joe Otting, and entitled "PINCH TUBE VALVE." A preferred form of valve is described hereinbelow with particular reference to FIGS. 5, 6 and 7.

A suitable controller 90 (FIGS. 3 and 4) is provided to individually control valves in the valve blocks 84, 86 and 88. A wide variety of controllers are suitable, and there is therefore no intention to limit the present invention to any particular one form of controller. One of the features of the present invention is its versatility in being adaptable to a great many controllers and control concepts.

In the operation of the apparatus 10, the pickup roll 14 rotates, transferring base color dye from the reservior 12 onto the upper edge 22 of the doctor blade 16, whereupon the dye initially flows uniformly in a base color dye film down the doctor blade 22, to fall from the lower edge 24 thereof onto the carpet web 18. Added to the base color dye flowing down the doctor blade 16 are controlled discharges of additional dye colors from the various nozzle tube outlets 32, 34 and 36, which add different colors to the base color dye. Dye is thus mixed and spread on the doctor blade 16 for a wide variety of effects.

By way of specific example, the base color dye in the reservoir 12 may be light tan, and the dye colors selectively dispensed from the respective rows of nozzles 32, 34 and 36 may be dark blue, light green and yellow. Unique and pleasing mixing effects result.

It is optional with the carpet manufacturer user of the apparatus 10 whether to reciprocate any or all of the nozzle bars 26, 28 and 30. If the nozzle bars 26, 28 and 30 are reciprocated, additional pattern effects are produced. As previously mentioned, the reciprocation can be at different velocities through control of air pressure applied to individual pneumatic actuators 44, 46 and 48.

As may be seen from FIG. 1, an additional reciprocating nozzle bar 92 carrying a set of dye outlet tube ends 94 comprising stainless steel nozzle tubes and reciprocated by a pnuematic actuator 96 under the control of a pair of limit switches 97 may be provided, the nozzle tubes 94 applying still another dye color onto the roll 14, rather than on the doctor blade 16. These nozzle tube outlets 94 are similarly supplied from a dye manifold 98 through a valve block assembly 100 under pattern control.

It will be appreciated that an important portion of the applicator 10 comprises the more or less conventional pickup roll 14 and doctor blade 16 assembly which, in the absence of the present invention, would apply dye in a substantial uniform manner to the carpet web 18. Thus, pattern dyeing apparatus of the present invention may be adapted for convenient retrofit to an existing such uniform dyeing apparatus, through the provision of the suitably-mounted reciprocating nozzle bars 26, 28 and 30, the nozzle tubes 32, 34 and 36, and related control and actuating elements.

Referring now to FIG. 3, there is shown an overall representation in highly schematic form of one approach or arrangement for controlling the applicator 10 of FIG. 1. In particular, FIG. 3 illustrates how a representative one 48 of the reversible pneumatic actuators may be controlled, and how an exemplary individual dye control valve in representative valve block 88 may be controlled.

The FIG. 3 system is a pneumatic one, with electrical control valves. Accordingly, a compressor 101 is provided and supplies compressed air through an adjustable throttle valve 102 and through an electrically-operated two-way air valve 103 to appropriate input ports of representative reversible pneumatic actuator 48. The two exemplary limit switches 60 are arranged, through their respective electrical connections 104, to switch the air valve 103 from one position to the other as each limit of travel of the representative FIG. 1 nozzle bar 30 is reached. In operation, the actuator rod 54 moves in and out of the actuator body 48 as the air supply is switched between the input ports of the actuator 48 under control of the air valve 103, which is in turn controlled by the limit switches 60. The actuator 54 then imparts reciprocating motion to the nozzle bar 30. Through adjustment of the throttle valve 102, the reciprocation velocity may be controlled.

A similar arrangement is provided for each of the other FIG. 1 pneumatic actuators 44, 46 and 96, and their motions and velocities can be independently controlled.

In FIG. 3 the compressor 101 additionally supplies compressed air to an air manifold 105, which in turn supplies air for operating each of the many individual dye control valves, such as a representative individual dye control valve 106 in the valve block 88. While a suitable structure for the valve 106 is described hereinbelow with particular reference to FIGS. 5, 6 and 7, in general the valve 106 operates by selectively pinching closed the flexible tube portion 76 under control of an electrically-operated pilot valve 107, in turn controlled by the pattern controller. Preferably, dye flow through every single nozzle in the applicator 10 is controlled by an individual output of the pattern controller 90.

Figure 4:
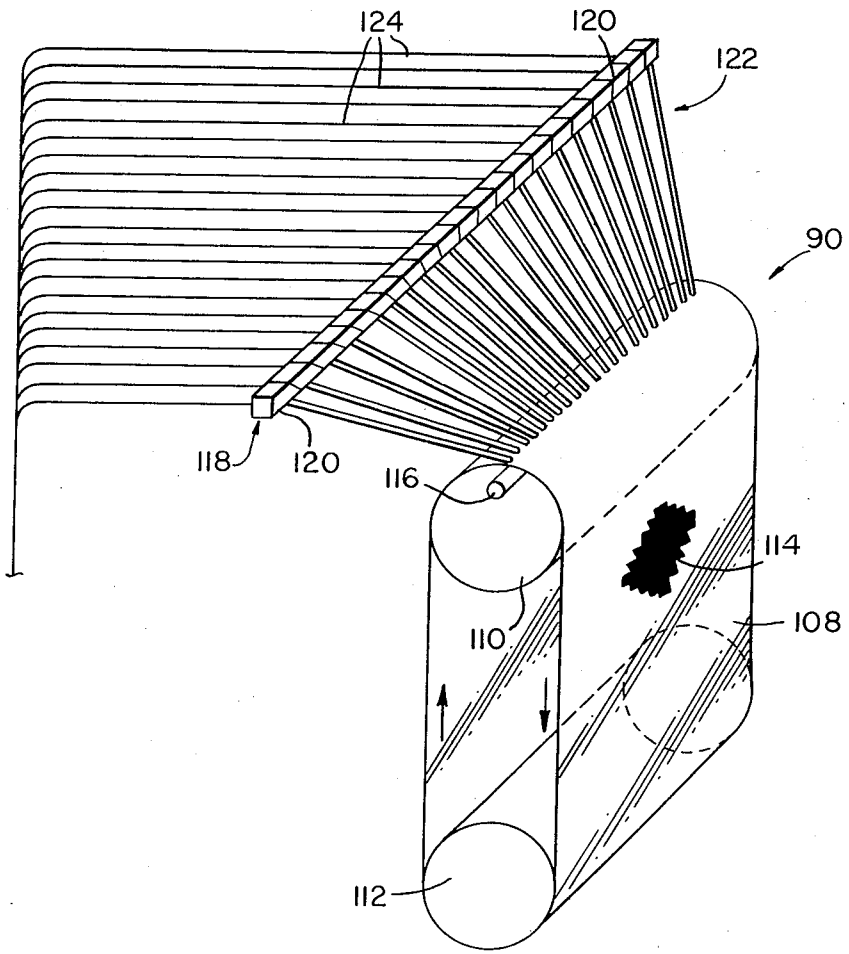
FIG. 4 is a highly schematic depiction of one form of controller suitable for use in actuating the controllable valves in the carpet dyeing apparatus of the invention.

While various forms of controllers may be employed, ranging from sophisticated computer controlled controllers to simply optical mechanical controllers, FIG. 4 illustrates a presently preferred form of pattern controller 90 in highly schematic form. Although the controller 90 operates on a photoelectric principle, it will be appreciated that suitable controllers will take various forms such as electrically or optically sensed rotating drums or endless webs, coded punch cards, coded magnetic tapes, coded magnetic discs, and various forms of computer based controllers employing either or both of mass storage (e.g., magnetic tape or disc) and high speed random access memories. Those skilled in the art of carpet manufacture will recognize that the controller 90 of FIG. 4 is similar in concept to controllers conventionally employed for pattern carpet tufting machines. It will further be appreciated that, whatever controller is selected must provide properly coordinated outputs for individual ones of the valve blocks 84, 86, 88 and 100, and the individual valves in each valve block.

More specifically, the FIG. 4 controller 90 comprises an endless, generally light transmissive web 108, such as Mylar or acetate film, carried by suitable rotating rollers 110 and 112. Representative pattern information is recorded on the film 108 in the form of an opaque area 114 which will ultimately result in a repeating series of controlled valve actuations resulting in a pattern on the carpet depending also upon the positioning of the respective reciprocating nozzle bar 26, 28 and 30 at the time of valve actuation. Within the upper roller 110 is a tubular light source 116. To photoelectrically sense the pattern information, and array 118 of photoelectric elements 120 is provided, together with a fiber optic array 122 to transmit the light signals. The photoelectric elements 120 each comprise a suitable sensor (not shown), such as a phototransistor, and suitable electronic interfacing circuitry. The photoelectric elements 120 serve to output signals on corresponding output lines 124 when light supplied thereto is blocked by the opaque pattern area 114. It will be appreciated that the lines 124 are connected either directly or indirectly to individual dye control valves in the valve blocks 84, 86, 88 and 100.

The fiber optic array 124 thus permits relatively close spacing (e.g., 0.01 inch) of individual pattern elements carried on the Mylar or acetate film 108, while allowing wider spacing as a practical matter between the much larger photoelectric elements 120. A relatively miniaturized controller 90 can thus be provided.

Figure 5:
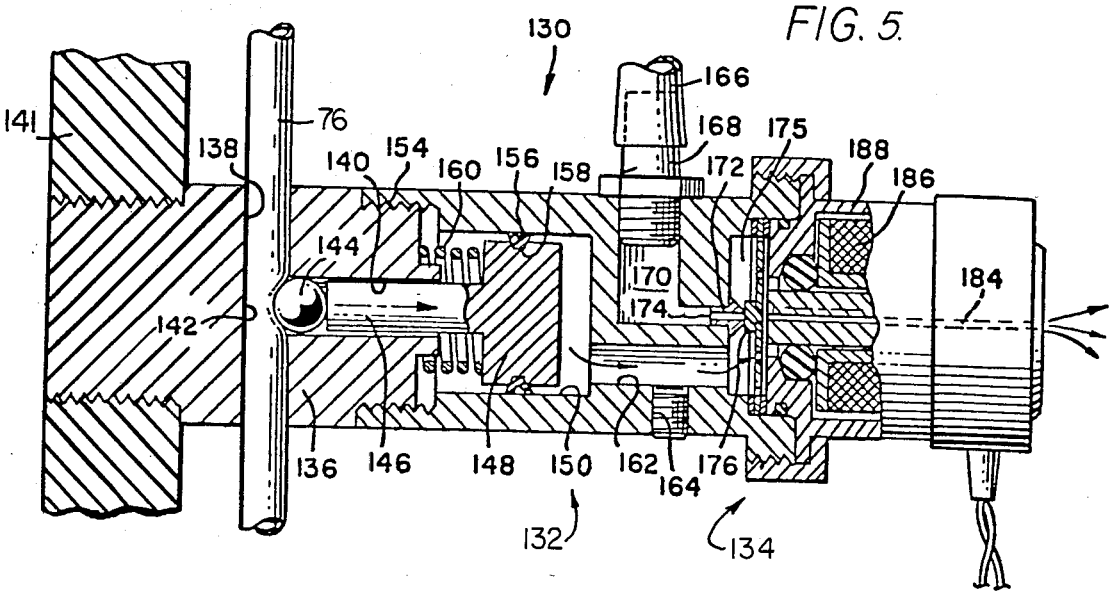
FIG. 5 is a cross sectional view of a preferred form of pinch tube valve assembly.
Figure 6:
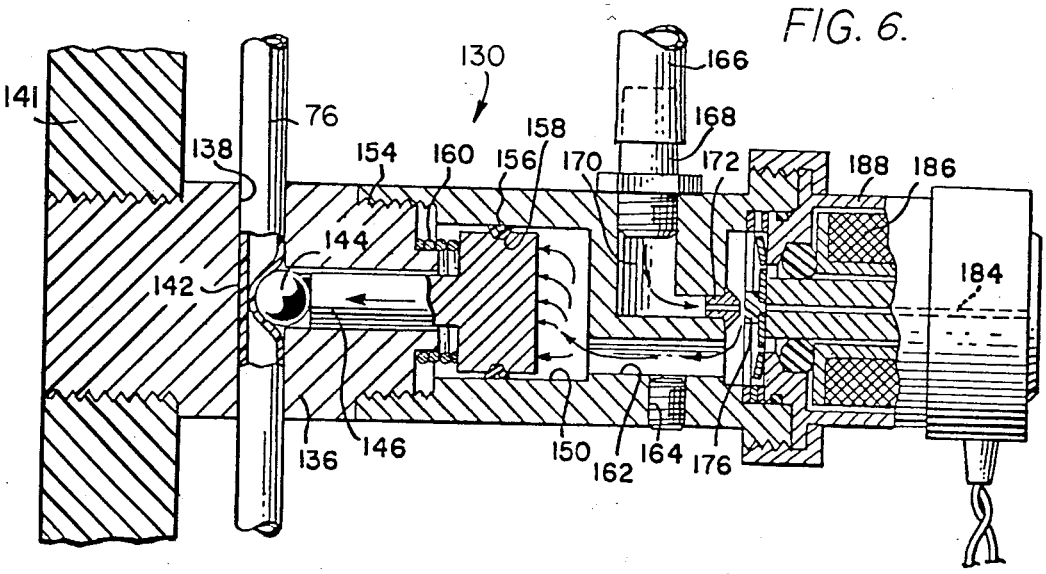
FIG. 6 illustrates the valve of FIG. 5 in the actuated position wherein the flexible tube portion is pinched closed.
Figure 7:
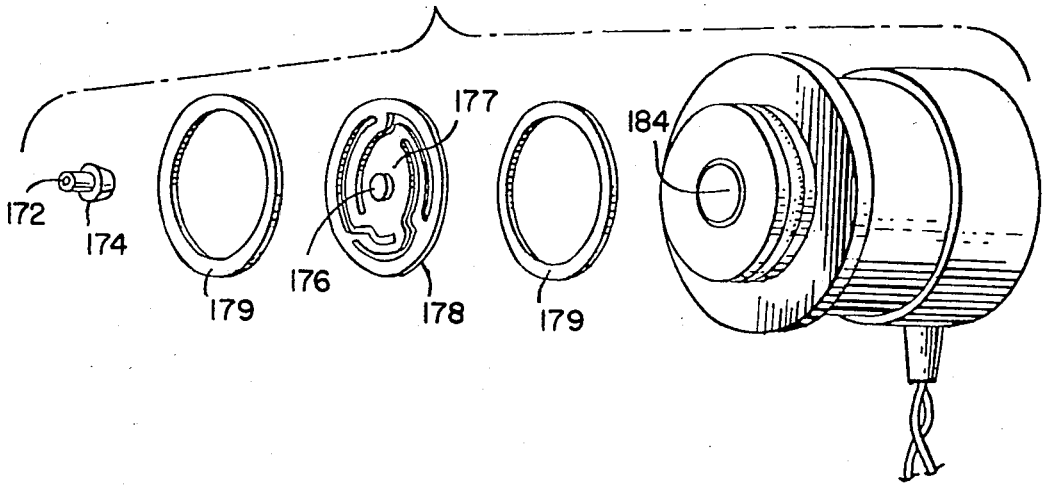
FIG. 7 is an exploded isometric view of a portion of the electrically actuated air valve of the valve arrangement of FIGS. 5 and 6.

Referring now to FIGS. 5, 6 and 7, there is shown a preferred valve constuction 130, FIG. 5 depicting the valve 130 open condition, and FIG. 6 depicting the valve 130 closed position. The valve 130 is a representative one, and is one of the many included in representative valve block 88 (FIG. 1) to selectively pinch closed representative dye delivery tube flexible portion 76. In the FIG. 5 valve open condition, dye freely flows from the FIG. 1 manifold 82 through the flexible tube 76 to the nozzle tube 36. In the FIG. 6 valve closed position, the flexible tube 76 is pinched off. This preferred form of valve is more particularly described and claimed in the copending application Ser. No. 086,392 filed Oct. 18, 1979 by Billy Joe Otting.

The valve 130 of FIGS. 5–7, generally comprises a pneumatic actuator 132 and an electromagnetically actuated valve portion 134. A tube receiving portion 136 of the valve 130 includes a bore 138 and a communicating passageway 140 at right angles thereto. The tube receiving portion 136 is mounted by means of threads to a support member 141. A flattened portion 141 is formed in the wall of the bore 138 opposite the passageway 140. The passageway 140 receives a ball 144 which actually bears against the tube flexible portion 76. A piston rod 146 actuated by a pneumatic piston 148 in turn bears against the ball 144.

The piston 148 reciprocates within a cylindrical chamber 150 formed in an intermediate portion 152 screw threaded as at 154 to mate with the tube receiving portion 136. An annular seal 156 received in an annular groove 158 of the piston 148 bears against the walls of the cylindrical chamber 150, and a compression spring 160 is provided to urge the piston 148 and piston rod 146 towards the valve-open position illustrated in FIG. 5.

The right-hand end of the intermediate portion 152 includes a passageway 162 for introducing air into and exhausting air from the cylindrical chamber 152 for actuation of the piston 148. A plugged bore 164 communicates with the passageway 162 for selectively controlled venting for valve modulation effects if desired.

The electromagnetic valve portion 134 of the valve 130 may be identical to that disclosed in the Clippard, Jr. et al U.S. Pat. No. 3,921,670, to which reference may be had for further details. The valve portion 134 functions when actuated (FIG. 6) to permit compressed air supplied through a tube 166 and fitting 168 from the compressed air manifold 105 (FIG. 3) into a passageway 170 terminating at a small diameter bore 172 in the end of a truncated insert member 174 communicating with a chamber 175. Air in the chamber 175 is then introduced through the passageway 162 to act against the piston 168 forcing the flexible tube portion 76 closed. In the valve deactuated position as illustrated in FIG. 5, the small diameter bore 172 is closed off by an elastomeric button 176 carried in the central portion 177 of a spider-like spring member 178, best seen in FIG. 7. Spacer rings 179 serve to axially position the spider member 178. In the FIG. 5 valve-deactuated position, the cylindrical chamber 150 is vented through the passageway 162 and the chamber 175 and through a passageway 184 to the atmosphere. This permits the piston 168 to retract to the position of FIG. 5.

The spider member central portion 177 serves as an armature selectively operated by a twenty-four volt DC electromagnetic coil 186 including suitable ferromagnetic structure 188. When the coil 186 is energized, the spider armature 177 is pulled radially away from the small passageway 172 permitting compressed air introduced via the tube 166 to ultimately act on the piston 148. This also causes the elastomeric button 176 to seal off the vent passageway 184. When the electromagnetic coil 186 is not energized, resilience of the spider member 178 urges the elastomeric button 176 against the small diameter passageway 172 closing off the flow of incoming compressed air, and at the same time opening the chamber 175 to the vent passageway 184.

From the foregoing, it will be appreciated that the present invention provides a versatile, yet low cost carpet dyeing applicator which places in the hands of the carpet dyeing industry the means to produce a wide variety of novel and visually-pleasing carpet dyeing effects.

While specific embodiments of the invention have been illustrated and described herein, it is realized that modifications and changes will occur to those skilled in the art. It is therefore to be undertood that the appended claims are intended to cover all such modifications and changes as fall within the true spirit and scope of the invention.

What is claimed is:

1. An applicator for applying dye in liquid form to a moving web of fabric, carpet, or the like, said applicator adapted to be positioned above the web and comprising:

a dye supply trough extending across the moving web; an inclined distributing plate extending across the width of the web transverse to the direction of web travel and having an upper edge and a lower edge with the lower edge of said distributing plate positioned such that dye flowing off the lower edge falls on the fabric web;

a dye pick-up roller partially immersed in said trough and adapted to be rotated for transferring liquid dye of a base color onto said distributing plate at an upper edge thereof to form a base color dye film initially flowing substantially uniformly downwardly over said distributing plate;

a first plurality of nozzle bars above said roller and a second plurality of nozzle bars above said inclined plate, said bars extending across the width of the web and spaced from each other in the direction of travel of the carpet web, each of said plurality of nozzle bars carrying a set of dye delivery tubes having spaced outlet ends forming a row positioned above and directed towards said distributing plate for adding dyes of additional colors to the base color dye film in selected areas of said distribution plate so as to cause the added dyes and the base dye to mix on areas of said distribution plate prior to flowing off the lower edge;

a plurality of reciprocating mechanisms corresponding to said plurality of nozzle bars for independently reciprocating said nozzle bars carrying dye delivery tubes back and forth in a direction transverse to the direction of web travel; and a controlled valving arrangement for selectively controlling the flow of dye from each of said dye delivery tubes.

2. An applicator according to claim 1, wherein said inclined distributing plate comprises a doctor blade whereby dye is scraped from the dye pick-up roller by the upper edge of said doctor blade.

3. For retrofit combination with a carpet dyeing machine for dyeing a continuously moving carpet web driven continuously along a horizontal path including a rotating roller supplied with base color dye liquid from a trough, an inclined flat blade for scraping dye from the roller to cause a film of base color dye to flow uniformly downwardly over the doctor blade to fall from the ower edge of the doctor blade onto the carpet web conveyed therebelow, pattern dyeing apparatus comprising:

a plurality of nozzle bars spaced above the roller and blade in the direction of travel of the web and extending across the width of the carpet web, each bar carrying a plurality of delivery tubes having spaced outlet ends and disposed in a row positioned above and directed towards the doctor blade for adding dye or chemical of at least one additional color or other characteristic to the base color dye film on the roller and in selected areas of the doctor blade so as to cause a mixing thereof on said flat blade before the dye falls from the lower edge.

4. A method of dyeing carpet while being continuously driven along a substantially horizontal path so as to form patterns thereon, said method comprising the steps of:

forming a base color dye film of a width substantially equal to the width of the textile material on a roller from which said dye is applied to a flat inclined plate;

controllably discharging liquid streams of additional dye color or chemical onto the previously formed base color dye film on the roller and the inclined plate in selected areas of the inclined plate so as to mix the dye film with the additional dye color or chemical while they are on the inclined plate, and depositing the base color dye and the additional dye or chemical onto the carpet by allowing liquid to fall by gravity from the lower edge of the inclined plate onto the carpet.

5. Apparatus for pattern dyeing a continuously moving carpet web as it is conveyed continuously along a substantially horizontal path past a dye applicator station comprising:

a dye applicator at said station positioned above the path of said carpet web and extending across the width of the carpet web transverse to the direction movement to the carpet web;

said applicator including a dye supply trough extending across the carpet web, a rotatable pick-up roller partially immersed in said trough and an inclined dye distributor plate having an upper edge positioned adjacent the roller and a lower edge positioned above and extending the width of the carpet such that upon rotation of said roller, dye from said trough is transferred to said plate at the upper edge thereof and caused to flow substantially uniformly downwardly over the surface of said plate and over the lower edge onto the carpet, a plurality of independent dye delivery means disposed to deliver and apply a plurality of streams of dye onto the exposed surface portion of the pick-up roller in said trough and the said plate and the dye flowing downwardly thereon;

each said independent dye delivery means including a dye source manifold adapted to be maintained under pressure and an air manifold adapted to be maintained under pressure, a nozzle bar, a plurality of dye delivery tubes supported by said nozzle bar, each tube having an inlet end and an outlet end and at least an intermediate portion thereof which is flexible so as to permit pinching of the flexible portion for selective control of dye flowing through the tube from the dye source manifold and a pinch tube valve assembly connected to the air manifold and receiving each of said intermediate portions for selectively pinching the associated tube to control dye flow there;

each of said plurality of dye delivery tubes of an independent dye delivery means being supported near its outlet end by an associated nozzle bar, a first of said nozzle bars being disposed above the exposed surface of a roller and a second of said nozzle bars being disposed above said inclined plate whereby dye from said outlet ends of tubes supported by said first nozzle bar is applied to the exposed surface of the pick-up roller and dye from said outlet ends of tubes supported by said second-nozzle bar is applied to the plate and the dye flowing thereon, each said independent dye delivery means having their associated dye delivery tubes forming a row across the width of the carpet web with each row being spaced from the other in the direction of the travel of the carpet such that dye from the dye delivery tubes above the plate is applied at different heights along the inclined plate and caused to mix with the dye from the supply trough and dye from said other of said nozzle bars applied to the exposed surface of the pick-up roller and thereafter flow over the lower edge of the plate onto the carpet web.

6. Apparatus according to claim 5 which further comprises:

means for reciprocating said nozzle bars and associated delivery tubes.

7. Apparatus according to claim 6, wherein said means for reciprocating said nozzle bars and delivery tubes reciprocates said nozzle bar and delivery tubes back and forth in a direction transverse to the direction of web travel and comprises;

a reversible pneumatic actuator; and a limit switch arrangement for sensing the limit of nozzle bar travel in either direction and reversing said pneumatic actuator when either limit of travel is reached.

8. Apparatus according to claim 6, wherein each independent dye delivery means is connected to a different dye source and which further comprises a controlled valving arrangement for selectively providing dye of said at least one different color to individual ones of a row of delivery tubes under pattern control.

9. Apparatus according to claim 8, wherein such said pinch tube valve assemblies disposed to receive the flexible portions of an associated group of dye delivery tubes supported by a nozzle bar, said pinch tube valve assemblies each including a valve block portion, a bore in said valve block portion receiving the corresponding dye delivery tube flexible portion, a passageway in said valve block portion communicating with and disposed generally transversely to said bore, the intersection of said bore and said passageway defining a pinch chamber, a tube pinch-off member selectively reciprocal within said passageway into said bore for forcing the corresponding dye delivery tube closed and an actuator for selectively urging said tube pinch off member against the corresponding dye delivery tube.

10. Apparatus according to claim 9 wherein said pinch chamber includes a flattened wall portion circular in shape and being formed in said bore opposite the intersecting passageway and said flattened wall portion being in a plane perpendicular to said intersecting passageway so as to form an expansion chamber for said tube upon pinching thereof; and controller means for selective actuation of the pinch tube valve assembly as the carpet web is conveyed past the applicator station to effect dyeing of the carpet web in the desired pattern.

11. A method as set forth in claim 4 wherein the liquid streams are applied in rows across the width of the roller and the inclined plate, each row being spaced from another in the direction of travel of the carpet.

12. A method according to claim 4 including independently laterally varying, in reciprocating fashion, the position of the liquid streams directed onto the roller and the inclined plane.

13. Apparatus according to claim 5 wherein said plurality of dye delivery means at said station are spaced along the direction of travel of said carpet web, each said dye delivery means being supplied with a different dye such that the pattern is a multicolor design.

14. Apparatus according to claim 5, wherein said dye manifold is maintained at a pressure between twenty and sixty psi.

15. An applicator according to claim 5, wherein said inclined distributing plate comprises a doctor blade whereby dye is scraped from the dye pick-up roller by the upper edge of said doctor blade.

16. Pattern dyeing apparatus according to claim 3, which further comprises a mechanism for independently reciprocating said nozzle bars and delivery tubes transversely of said inclined doctor blade during addition.

17. Pattern dyeing apparatus according to claim 16, wherein said mechanism for transversely reciprocating said nozzle bars and delivery tubes comprises:

a reversible pneumatic actuator; and a limit switch arrangement for sensing the limit of nozzle bar travel in either direction and reversing said pneumatic actuator when a limit of travel is reached.

18. Apparatus for producing diffused variegated patterns in pile fabrics comprising:

(a) an applicator member having (i) an applicator edge positionable parallel to and across a width of moving length of fabric, and (ii) a smooth upper surface inclined toward said applicator edge;

(b) means for delivering a first coating material onto said smooth upper surface to form a continuous sheet thereof flowing by gravity toward said applicator edge;

(c) a distribution means including (i) at least one array of nozzles positioned for delivery of at least one additional coating material onto the continuous sheet upstream of said applicator edge, said array of nozzles including at least one row of nozzles aligned transversely of the path of travel of the fabric, (ii) an elongate distributor member having a plurality of apertures therein, (iii) a plurality of conduits in individual communication between one of said distributor apertures and one of said nozzles, said conduits each including a flexible duct and a valve and (iv) delivery means for selectively delivering said additional coating material through selected nozzles of said array of nozzles to interdisperse with the continuous sheet of the first coating material while upon said smooth upper surface; and (d) a supporting bed for supporting a length of fabric in a substantially horizontal position to permit the length of fabric to move in a downstream direction and to permit the first and additional coating materials to penetrate into the fabric by force of gravity when the fabric is on the supporting bed.

19. Apparatus for producing diffused variegated patterns in fabrics comprising:

(a) an applicator member having an applicator edge positionable across the width of a length of fabric moving in a downstream direction, and a smooth upper surface on said applicator member and inclined toward said applicator edge;

(b) means for delivering a first coating material onto said smooth upper surface to form a continuous sheet thereof flowing by gravity toward said applicator edge;

(c) a distribution means comprised of:

(i) at least one array of nozzles positioned for delivery of at least one additional coating material onto the continuous sheet upstream of said applicator edge, said array of nozzles including at least one row of nozzles aligned transversely of the path of travel of the fabric;

(ii) an elongate distributor member having a plurality of apertures therein, (iii) a plurality of conduits, each conduit in individual communication between one of said distributor apertures and one of said nozzles, and the conduits including a flexible duct and a valve and (iv) delivery means for selectively delivering said additional coating material through selected nozzles of said array of nozzles to interdisperse with the continuous sheet of coating material while on said smooth upper surface; and (d) means for supporting the fabric to permit the coating materials flowing over the applicator edge to penetrate the fabric by force of gravity.

20. The apparatus of claim 18 in which said flexible ducts are of equal length and of sufficiently low flow area to comprise flow-stabilizing resistance lines, whereby dripping of material at said nozzles is precluded when said valve in said conduit is closed.

21. The apparatus of claim 19 in which said flexible ducts are of equal length and of sufficiently low flow area to comprise flow-stabilizing resistance lines, whereby dripping of material at said nozzles is precluded when said valve in said conduit is closed.

* * * * *